US008032044B2

(12) United States Patent
Tomiyasu et al.

(10) Patent No.: US 8,032,044 B2
(45) Date of Patent: Oct. 4, 2011

(54) IMAGE FORMING APPARATUS

(75) Inventors: Hiroaki Tomiyasu, Toride (JP); Ryo Hanashi, Moriya (JP); Masahiro Komoto, Toride (JP)

(73) Assignee: Canon Kabushiki Kaisha (JP)

( * ) Notice: Subject to any disclaimer, the term of this patent is extended or adjusted under 35 U.S.C. 154(b) by 444 days.

(21) Appl. No.: 12/182,052

(22) Filed: Jul. 29, 2008

(65) Prior Publication Data

US 2009/0035005 A1 Feb. 5, 2009

(30) Foreign Application Priority Data

Jul. 30, 2007 (JP) ..... 2007-197494

(51) Int. Cl.
*G03G 15/20* (2006.01)

(52) U.S. Cl. ..... 399/68; 399/82; 399/320

(58) Field of Classification Search ..... 399/16, 399/38, 68, 82, 409, 410, 320, 328, 406
See application file for complete search history.

(56) References Cited

U.S. PATENT DOCUMENTS

| | | | | |
|---|---|---|---|---|
| 5,978,561 | A | 11/1999 | Kimura et al. | |
| 6,829,448 | B2 | 12/2004 | Ozawa et al. | |
| 2004/0002015 | A1 | 1/2004 | Ozawa et al. | |
| 2006/0216048 | A1* | 9/2006 | Fujii et al. | 399/45 |
| 2009/0028587 | A1 | 1/2009 | Hanashi et al. | |

FOREIGN PATENT DOCUMENTS

| | | | |
|---|---|---|---|
| JP | 7-84483 | A | 3/1995 |
| JP | 10-97142 | A | 4/1998 |
| JP | 2003-248349 | A | 9/2003 |
| JP | 2006-150798 | A | 6/2006 |
| JP | 2006-243498 | A | 9/2006 |
| JP | 2006-349755 | A | 12/2006 |

OTHER PUBLICATIONS

Machine translation of JP 2006-243498.*
Extended European Search Report issued in corresponding EP 08159438.4-2209, dated Jan. 23, 2009.
Specification, claims, abstract and drawings of related co-pending application, U.S. Appl. No. 12/182,058, filed Jul. 29, 2008; 40 pages.

* cited by examiner

*Primary Examiner* — David Gray
*Assistant Examiner* — Barnabas Fekete
(74) *Attorney, Agent, or Firm* — Rossi, Kimms & McDowell LLP

(57) ABSTRACT

An image forming apparatus capable of preventing toner fusion between recording sheets, with a construction that does not require increase in cost and size of the apparatus and does not unduly lower productivity, to thereby offer high usability. For image formation on plural pieces of recording sheets, a CPU controls a recording sheet conveyance interval for a first set based on a detected amount of toner used for the image formation on each page, stores the toner use amounts for respective pages of the first set into a RAM, and controls the recording sheet conveyance interval for second and subsequent sets based on the toner use amount stored in the RAM for each page.

6 Claims, 15 Drawing Sheets

IMAGE FORMING APPARATUS

BACKGROUND OF THE INVENTION

1. Field of the Invention

The present invention relates to an image forming apparatus, and more particularly, to an image forming apparatus for preventing stacking failure of discharged recording sheets and alignment failure at the time of post-processing on recording sheets due to toner fusion and for suppressing a reduction in productivity.

2. Description of the Related Art

In a conventional image forming apparatus in which a toner image is thermally fixed to a recording sheet, toner fusion sometimes takes place between stacked recording sheets, which are raised in temperature at thermal fixing, when post-processing is carried out thereon. As a result of the toner fusion, toner images are peeled off from recording sheets and stacking failure of recording sheets is caused, which poses a problem.

To obviate this, it has been proposed to cool a transfer guide member by means of a cooling fan disposed near a sheet discharge port, thereby cooling recording sheets before being subjected to post-processing (see, for example, Japanese Laid-open Patent Publication No. 2006-349755).

Moreover, for a case where recording sheets such as OHP sheets between which toner fusion easily occurs are used, there has been proposed a cooling system in which the discharge of recording sheets onto a stacking tray is temporarily delayed, thereby cooling the recording sheets (see, for example, Japanese Laid-open Patent Publication No. 2003-248349). With this cooling system, however, when applied to an image forming apparatus having a fear that toner fusion occurs even between ordinary sheets, the sheet discharging time interval must be increased at the time of post-processing on the ordinary sheets, resulting in a high possibility that user's demand on improved productivity cannot be satisfied.

To solve this problem, it has been proposed to detect the toner density on each recording sheet and change the sheet discharge interval, if the detected density is greater than a critical density at or above which toner fusion takes place (see, for example, in Japanese Laid-open Patent Publication No. 2006-243498).

In a small machine demanded to be compact in size and low in cost, however, conventional cooling means such as a cooling fan for cooling recording sheets cannot positively be adopted. Especially in a small machine for office use, a thermal fixing mechanism is disposed adjacent to a sheet discharging part, and therefore, it is difficult to find an installation space for a cooling fan. Since a sheet discharge tray is small in size, a cooling fan is also difficult to be installed on the sheet discharge tray.

In the conventional arrangement, the sheet discharging time interval for recording sheets between which toner fusion is liable to occur is changed in accordance with the determined toner density, and the sheet discharge interval for the next recording sheet is increased when the toner density on the preceding recording sheet is determined to be greater than the critical density.

The conventional arrangement is therefore effective for a machine in which image formation on each recording sheet is started after the toner density on the preceding recording sheet is determined. Such an arrangement is also effective for a machine (such as an image forming apparatus), though in which the image formation interval is long, but which includes a speed-up mechanism to decrease the sheet discharge interval.

However, in a machine in which a transfer path is short in length and a speed-up mechanism is not included, the sheet discharge interval is short and the next image formation is started before completion of the determination of the toner density on the preceding recording sheet. This makes it difficult to selectively increase the next sheet discharge interval in accordance with the preceding image density.

If the sheet discharge interval is controlled to always be made large, on the other hand, the productivity is lowered and the usability is largely impaired.

SUMMARY OF THE INVENTION

The present invention provides an image forming apparatus capable of preventing toner fusion between recording sheets to thereby offer high usability, with a construction which does not cause substantial increase in cost and size of the apparatus and an undue reduction in productivity.

According to the present invention, there is provided an image forming apparatus comprising a transfer unit adapted to transfer a toner image onto a recording sheet, a detection unit adapted to detect a toner use amount at toner image transfer by the transfer unit, a storage unit adapted to store toner use amounts detected by the detection unit for respective pages, and a control unit adapted to control a recording sheet conveyance interval, wherein in a case where image formation is carried out on plural sets of recording sheets, the control unit controls the recording sheet conveyance interval for a first set of recording sheets based on the toner use amount detected by the detection unit for each page of the first set and causes the storage unit to store toner use amounts used for respective pages of at least the first set, and controls the recording sheet conveyance interval for second and subsequent sets based on the toner use amount stored in the storage unit for each page.

According to the present invention, it is possible to prevent toner fusion between recording sheets to thereby offer high usability, with a construction that does not cause increase in cost and size of the apparatus and an undue reduction in productivity.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
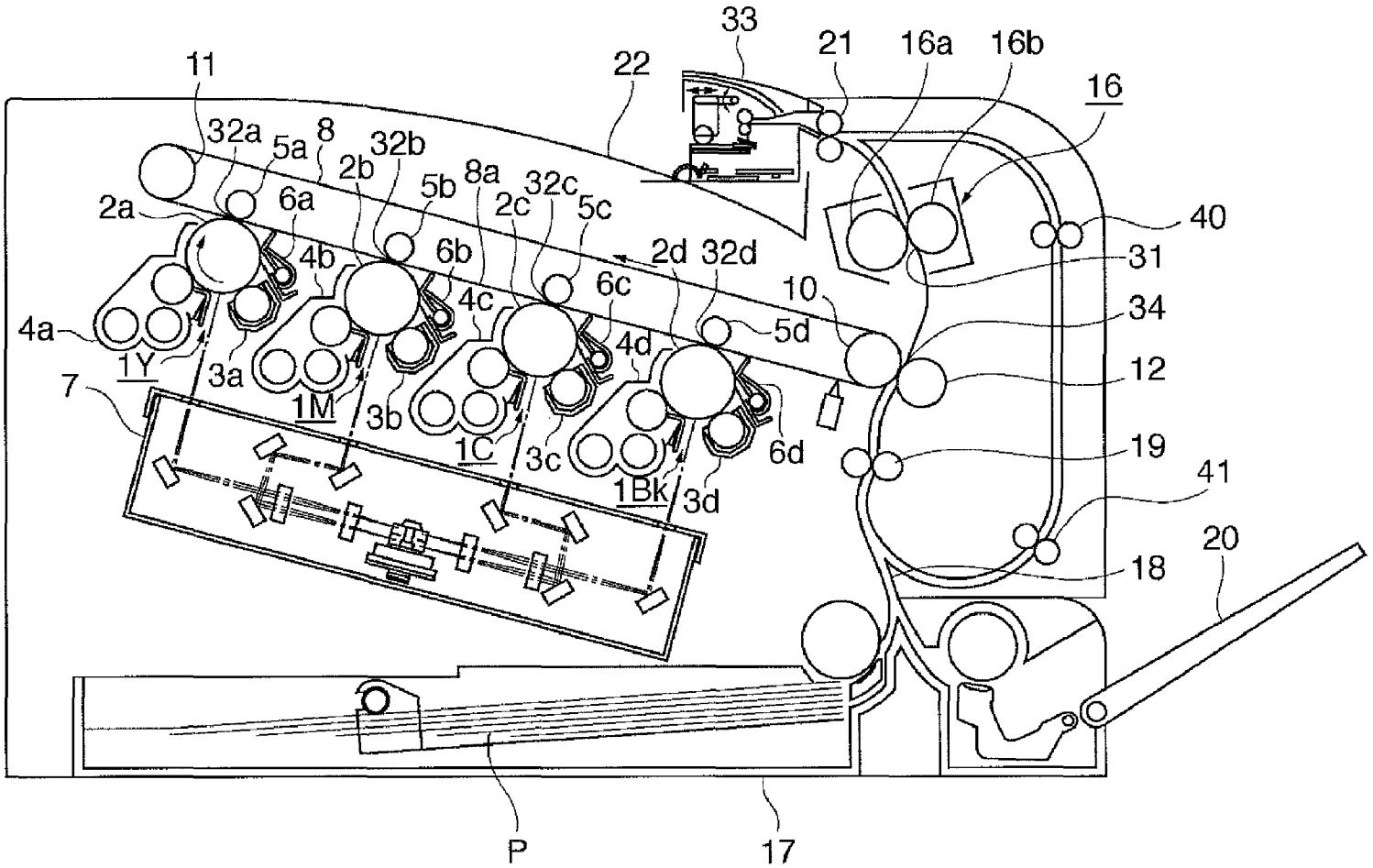
FIG. 1 is a view showing the construction of a full color printer as an image forming apparatus according to one embodiment of this invention.

FIG. 1 shows the construction of a full color printer as an image forming apparatus according to one embodiment of this invention.

The full color printer includes four image forming units. The four image forming units are image forming units 1Y, 1M, 1C, and 1Bk for forming an yellow colored image, a magenta colored image, a cyan colored image, and a black colored image, respectively. These image forming units 1Y, 1M, 1C, 1Bk are disposed on a line with a predetermined distance therebetween.

The toner image forming units 1Y, 1M, 1C, 1Bk respectively include drum-type electrophotographic photosensitive members (hereinafter referred to as the "photosensitive drums") 2*a* to 2*d* serving as image carriers.

Around the photosensitive drums 2*a*, 2*b*, 2*c*, 2*d*, there are disposed primary charging devices 3*a*, 3*b*, 3*c*, 3*d*, developing devices 4*a*, 4*b*, 4*c*, 4*d*, transfer rollers 5*a*, 5*b*, 5*c*, 5*d* as transfer units, and drum cleaners 6*a*, 6*b*, 6*c*, 6*d*.

A laser exposure unit 7 is disposed below the primary charging devices 3*a*-3*d* and the developing devices 4*a*-4*d*.

The developing devices 4*a*-4*d* respectively contain yellow toner, cyan toner, magenta toner, and black toner.

The photosensitive drums 2*a*-2*d* are each comprised of a negatively chargeable OPC photosensitive member having an aluminum drum member thereof formed with a photoconductive layer thereon, and are rotatably driven by a driving unit (not shown) at a predetermined process speed in a clockwise direction in FIG. 1.

The primary charging devices 3*a*-3*d* functioning as primary charging units uniformly charge surfaces of the photosensitive drums 2*a*-2*d* at a predetermined negative potential with charging bias applied from a charging bias power source (not shown).

The developing devices 4*a*-4*d* cause color toners to be adhered to electrostatic latent images formed on the photosensitive drums 2*a*-2*d*, to thereby develop (visualize) the electrostatic latent images into toner images.

The transfer rollers 5*a*-5*d* functioning as the primary transfer units are disposed for contact at primary transfer parts 32*a*-32*d* with the photosensitive drums 2*a*-2*d* via an intermediate transfer belt 8 functioning as a transfer unit.

The drum cleaners 6*a*-6*d* have cleaning blades for removing residual toner remaining on the photosensitive drums 2*a*-2*d* after the primary transfer.

The intermediate transfer belt 8 is disposed on the upper surface side of the photosensitive drums 2*a*-2*d* and stretched between a secondary transfer opposed roller 10 and a tension roller 11. The secondary transfer opposed roller 10 is disposed for contact at a secondary transfer part 34 with a secondary transfer roller 12 via the intermediate transfer belt 8. The intermediate transfer belt 8 is comprised of dielectric resin such as poly carbonate, poly ethylene terephthalate resin film, or poly vinylidene diffluoride resin film.

The intermediate transfer belt 8 is disposed to be inclined such that a primary transfer surface 8*a* thereof facing the photosensitive drums 2*a*-2*d* is at a lower height level on its secondary transfer roller 12 side than on another side thereof.

Specifically, the intermediate transfer belt 8 is movable relative to the photosensitive drums 2*a*-2*d* and inclined such that the primary transfer surface 8*a* is at a lower height level on the secondary transfer part 34 side than on the other side thereof.

More specifically, the angle of inclination is set at about 15 degrees. The intermediate transfer belt 8 is stretched between the secondary transfer opposed roller 10 disposed on the secondary transfer part 34 side for applying a driving force to the intermediate transfer belt 8 and the tension roller 11 for applying a tension force to the intermediate transfer belt 8, the tension roller 11 being disposed on the side opposite from the roller 10 with respect to the primary transfer parts 32*a*-32*d* disposed therebetween.

The secondary transfer opposed roller 10 is disposed for contact at the secondary transfer part 34 with the second transfer roller 12 via the intermediate transfer belt 8. On the outside of the endless intermediate transfer belt 8 and near the tension roller 11, there is disposed a belt cleaner (not shown) for removing and collecting residual toner remaining on the surface of the intermediate transfer belt 8.

On the side downstream of the secondary transfer part 34 in the direction in which a recording sheet P is conveyed, a fixing unit 16 including a fixing roller 16*a* and a pressurizing roller 16*b* is disposed in a longitudinal path construction.

The laser exposure unit 7 includes a laser emitting unit for emitting light in accordance with a time-series of electric digital image signals of given image information, and includes a polygon lens, a reflection mirror, and the like. The laser exposure unit 7 exposes the photosensitive drums 2*a*-2*d* to light, thereby forming electrostatic latent images in respective colors, corresponding to the image information, on the surfaces of the photosensitive drums 2*a*-2*d* which are charged by the primary charging devices 3*a*-3*d*.

Next, an image forming operation of the image forming apparatus (full color printer) is described.

When an image formation start signal is delivered, the photosensitive drums 2*a*-2*d* of the image forming units 1Y, 1M, 1C, 1Bk rotatably driven at a predetermined process speed are uniformly charged in negative polarity by the primary charging devices 3*a*-3*d*.

Next, the laser exposure unit 7 irradiates laser light from the laser emitting unit in accordance with a color-separated image signal which is externally input. The laser light is irradiated onto the photosensitive drums 2*a*-2*d* via the polygon lens, the reflection mirror, etc., whereby electrostatic latent images in respective colors are formed on the photosensitive drums 2*a*-2*d*.

Then, by means of the developing device 4*a* applied with a developing bias which is the same in polarity as the polarity of electrification (negative) of the photosensitive drum 2*a*, yellow toner is adhered to the electrostatic image formed on the photosensitive drum 2*a*, whereby the electrostatic latent image is visualized.

At the primary transfer part 32*a* between the photosensitive drum 2*a* and the transfer roller 5*a*, the yellow toner image is primary-transferred onto the intermediate transfer belt 8, which is being driven, by means of the transfer roller 5*a* applied with primary transfer bias (which is opposite (positive) in polarity to the toner).

The intermediate transfer belt 8 to which the yellow toner image has been transferred is moved toward the toner image forming unit 1M. Then, a magenta toner image formed on the photosensitive drum 2*b* in the toner image forming unit 1M is similarly transferred onto the intermediate transfer belt 8 at the primary transfer part 32*b* such as to be superimposed on the yellow toner image on the intermediate transfer belt 8.

At this time, residual toner remaining on the photosensitive drums 2*a*-2*d* is scraped off for recovery by means of cleaner blades or the like provided on the drum cleaners 6*a*-6*d*.

Similarly, cyan and black toner images formed on the photosensitive drums 2*c*, 2*d* of the image forming units 1C, 1Bk are sequentially superposed on the yellow and magenta toner images formed in layer on the intermediate transfer belt 8 at the primary transfer parts 32*c*, 32*d*. As a result, a full color toner image is formed on the intermediate transfer belt 8.

The recording sheet P is conveyed by registration rollers 19 to the secondary transfer part 34 between the secondary transfer opposed roller 10 and the secondary transfer roller 12 in timing in which the tip end of the full color toner image on the intermediate transfer belt 8 is moved to the secondary transfer part 34. The recording sheet P is fed via a conveyance path 18 from a sheet feed cassette 17 or a manual feed tray 20.

By means of the secondary transfer roller 12 applied with secondary transfer bias (which is opposite (positive) in polarity to the toner), the full color toner image is secondary-transferred onto the recording sheet P conveyed to the secondary transfer part 34.

The recording sheet P on which the full color toner image has been formed is conveyed to the fixing unit 16. The full color toner image is heated and pressurized at a fixing nip part 31 between the fixing roller 16*a* and the pressurizing roller 16*b*. As a result, the full color toner image is thermally fixed on a surface of the recording sheet P. Subsequently, the recording sheet P is caused by a sheet discharge roller 21 to enter a post-processing apparatus, described later, and discharged onto a sheet discharge tray 22 disposed on an upper surface of the main body of the apparatus. Whereupon, a series of image forming operations is completed.

Toner remaining on the intermediate transfer belt 8 after the secondary transfer is removed for recovery by the belt cleaner. In the above, the image forming operation at the time of single-sided image formation has been described.

Figure 2:
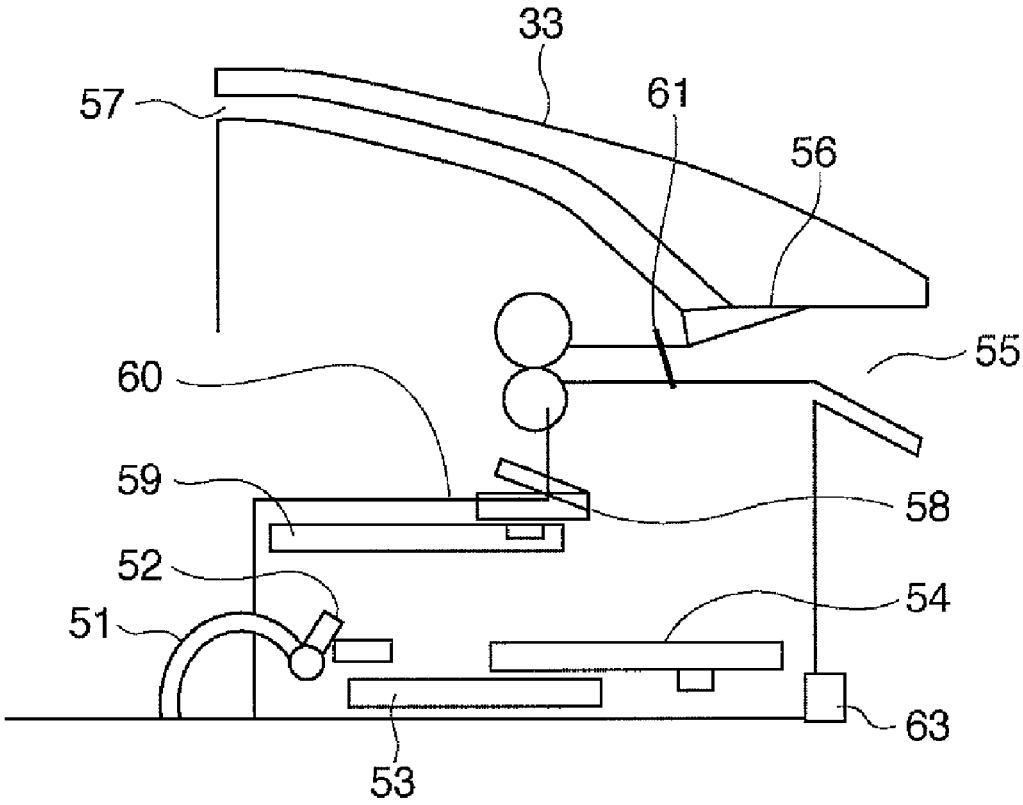
FIG. 2 is a view showing the construction of a post-processing apparatus in FIG. 1.
Figure 3:
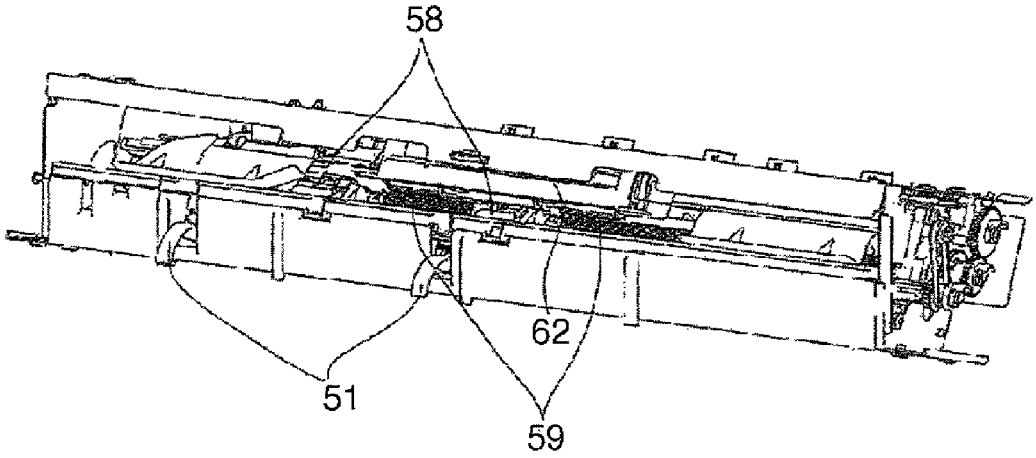
FIG. 3 is a view of the post-processing apparatus as seen from the side of a sheet discharge port thereof.

FIG. 2 shows the construction of the post-processing apparatus 33 in FIG. 1, and FIG. 3 shows the post-processing apparatus 33 as seen from the side of a sheet discharge port thereof.

Figure 4:
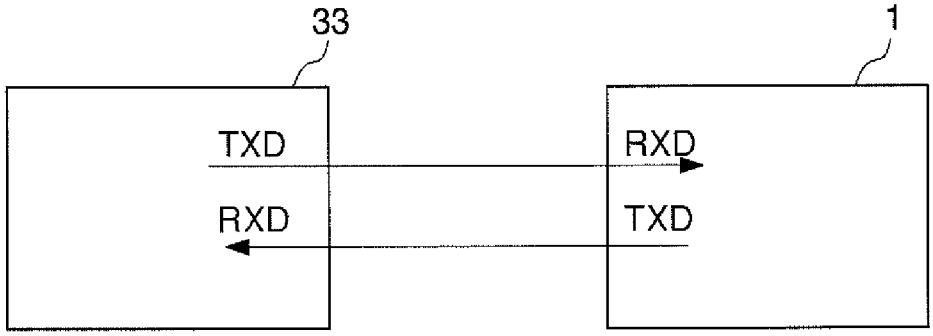
FIG. 4 is a view schematically showing communication between the post-processing apparatus and a printer unit.

The post-processing apparatus 33 for performing post-processing on a recording sheet P being discharged has a sheet entry port 55 formed therein such that the recording sheet P conveyed by the sheet discharge roller 21 enters the interior of the post-processing apparatus 33. The post-processing apparatus 33 has a communication connector 63 having a transmission data terminal TXD and a reception data terminal RXD which are respectively connected to a reception data terminal RXD and a transmission data terminal TXD of a printer unit (shown by reference numeral 1 in FIG. 4). In a process of being fed with a recording sheet from the printer unit 1, the post-processing apparatus 33 carries out communication for synchronization as shown in FIG. 4. The entry of the recording sheet through the sheet entry port 55 is detected by a sensor 61.

Recording sheets P entered in succession through the sheet entry port 55 are stacked on a bundle tray 60. The recording sheets P stacked on the bundle tray 60 are each moved by a sorting member 62 in a horizontal direction relative to a sheet discharge direction (sorting process).

Figure 5:
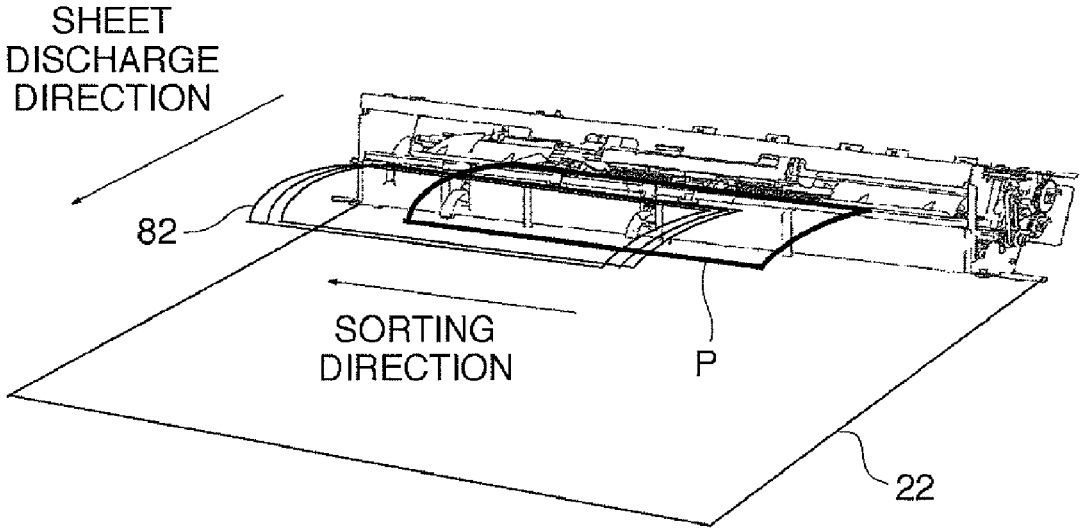
FIG. 5 is a view showing a sorting operation of the post-processing apparatus in FIG. 1.

As shown in FIG. 5, recording sheets P output from the printer unit 1 are each moved in the sorting direction so as to be aligned with one another. After a predetermined number of recording sheets are stacked (a stacked state is shown by reference numeral 82), these recording sheets are stapled, where required, by a stapler (not shown), and then discharged by means of bundle discharge sliders 58.

Bundle-discharge-slider pusher members 59 for driving the bundle discharge sliders 58 are drivingly coupled via coupling members (not shown) to sheet-restraint-pawl driving gears 54, whereby sheet restraint members 51 are driven. The sheet restraint members 51 are operable to restrain discharged recording sheets, thereby suppressing recording sheets after subjected to thermal fixing from being curled.

Paper-full detection flags 52 interconnected with the sheet restraint members 51 are adapted to turn on/off a sheet-full detecting sensor 53 and detect the sheet discharge tray 22 becoming full of sheets based on the thickness of discharged recording sheets P. When a changeover member 56 is switchingly operated, a recording sheet P is conveyed to a conveyance path 57 for sheet reverse in double-sided conveyance, described later.

Next, a description will be given of a double-sided image forming operation of the image forming apparatus of this embodiment.

Portions of the double-sided image forming operation up to a full color toner image is thermally fixed onto a recording sheet P by the fixing unit 16 are the same as relevant portions of the single-sided image forming operation. After completion of thermal fixing, the rotation of the sheet discharge roller 21 is stopped in a state in which most part of a recording sheet P is discharged onto the sheet discharge tray 22 by the sheet discharge roller 21.

At that time, the recording sheet P is stopped in a state where the rear end thereof reaches a reverse position. The changeover member 56 of the post-processing apparatus 33 is switchingly operated as previously described, and the recording sheet P in the post-processing apparatus 33 is located within the conveyance path 57.

Next, the recording sheet P stopped from being conveyed by stopping the rotation of the sheet discharge roller 21 is fed into a double-sided path having double sided rollers 40, 41 (FIG. 1). To this end, the sheet discharge roller 21 is reversely rotated in a direction opposite to the direction of normal rotation. By the reverse rotation of the sheet discharge roller 21, the recording sheet P located at the reverse position is conveyed so as to reach the double sided roller 40, with the rear end of the recording sheet P directed forward.

Thereafter, the recording sheet P is conveyed by the double sided roller 40 toward the double sided roller 41. Recording sheets P are conveyed in succession by the double sided rollers 40, 41 toward the registration rollers 19. During that time, an image formation start signal is generated.

As in the case of the single-sided image formation, each recording sheet P is moved by the registration rollers 19 toward the secondary transfer part 34 between the secondary transfer opposed roller 10 and the secondary transfer roller 12 in timing in which the tip end of a full color toner image on the intermediate transfer belt 8 is moved toward the secondary transfer part 34.

The toner image is transferred onto the recording sheet P in a state that the tip end of the toner image is made coincident with the tip end of the recording sheet P at the secondary transfer part 34. Subsequently, the image on the recording sheet P is fixed by the fixing unit 16 as in the case of the single-sided image forming operation. Then, the recording sheet P is conveyed again by the sheet discharge roller 21, is caused to enter the post-processing apparatus 33, and is finally discharged onto the sheet discharge tray 22. Whereupon, a series of image forming operations is completed.

Figure 6:
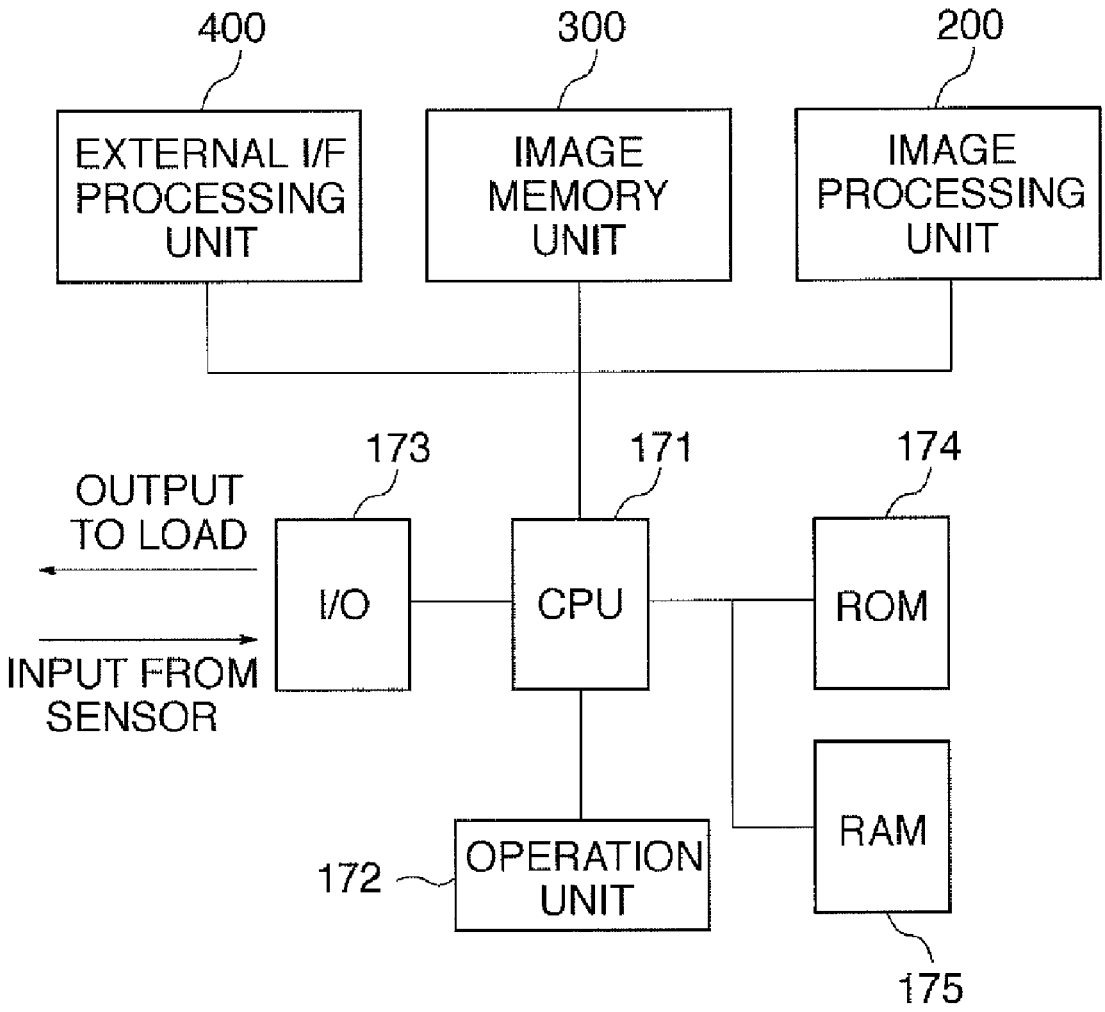
FIG. 6 is a diagram showing control blocks of the image forming apparatus in FIG. 1.

FIG. 6 shows control blocks of the image forming apparatus in FIG. 1.

Referring to FIG. 6, the CPU 171 that implements the basic control of the image forming apparatus is connected via address buses and data buses to a ROM 174 in which a control program is stored, a RAM (work RAM) 175 for temporarily storing calculation results, etc., and an input/output port (I/O) 173.

The CPU 171 functions as a detection unit for detecting a toner use amount at toner image transfer by the transfer unit, and functions as a control unit for setting a plurality of recording sheet conveyance intervals and changing the conveyance interval. The RAM 175 functions as a storage unit for storing toner use amounts used for respective pages.

Various loads (not shown) such as motors and clutches for driving the image forming apparatus and a sensor (not shown) for detecting the position of a recording sheet P are connected to the input/output port 173.

The CPU 171 carries out the image forming operations by controlling input and output via the input/output port 173 in accordance with the content stored in the ROM 174. The CPU 171 also controls a display unit and a key input unit of the operation unit 172 connected to the CPU 171.

An operator operates the key input unit to instruct the CPU 171 to switch an image forming operation mode and display. In response to the instruction, the CPU 171 displays the state of the image forming apparatus and the operation mode set by key input.

Connected to the CPU 171 are an external I/F processing unit 400 for transmitting and receiving image data, process data, etc. to and from external equipment such as a PC, an image memory unit 300 for decompressing and temporarily storing images, and an image processing unit 200 for performing image processing based on line image data transferred from the image memory unit 300.

Next, a description will be given of determination of toner fusion between recording sheets.

Since recording sheets are pressed to each other by the sorting member 62, there is a possibility that toner fusion takes place between the recording sheets.

Figure 7B:
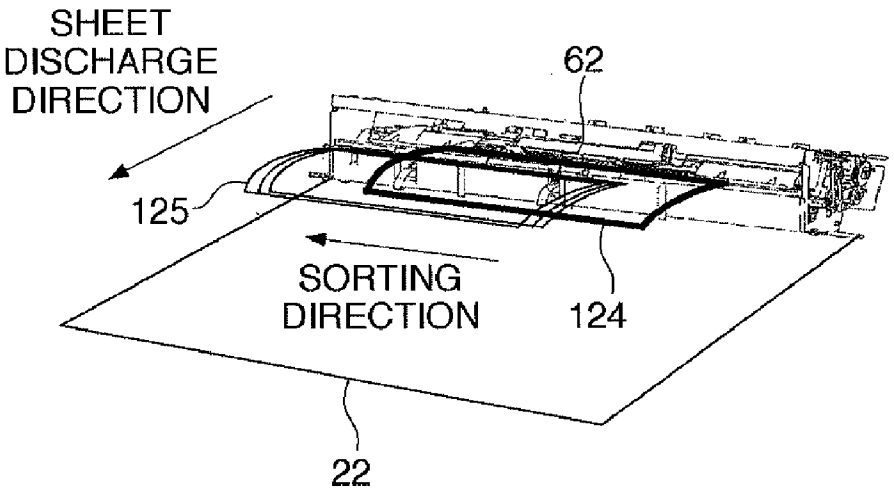
FIG. 7B is a schematic view of the post-processing apparatus as seen from obliquely above, with the sorting member positioned away from the recording sheet.
Figure 7A:
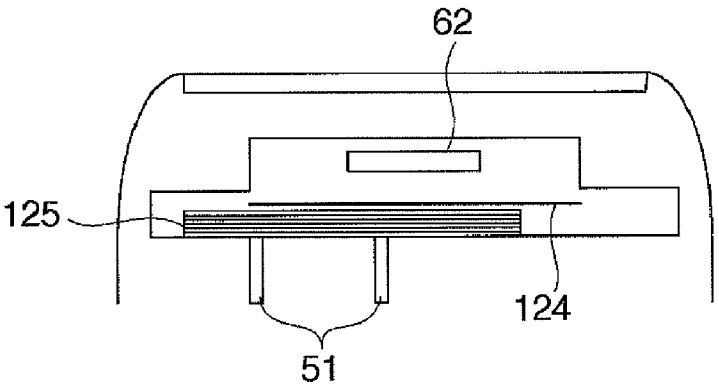
FIG. 7A is a schematic view of the post-processing apparatus as seen from the downstream side in the sheet discharge direction, with a sorting member in FIG. 3 positioned away from a recording sheet.
Figure 8B:
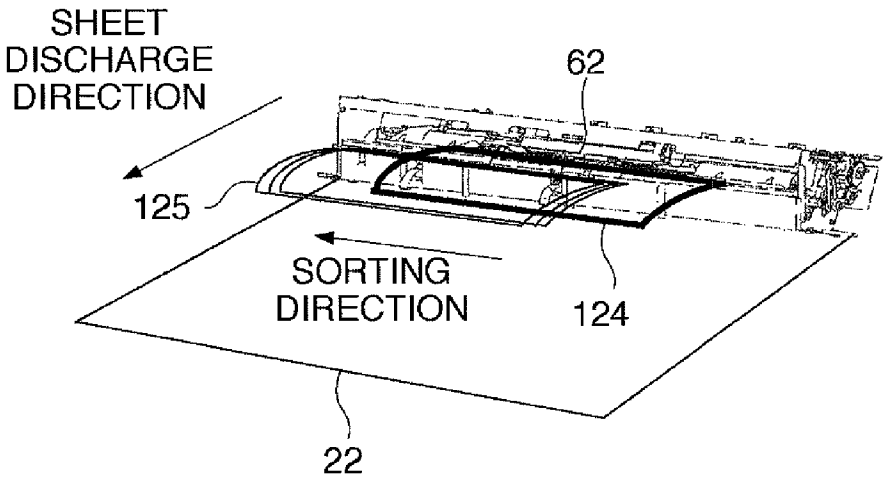
FIG. 8B is a schematic view of the post-processing apparatus as seen from obliquely above, with the sorting member in contact with the recording sheet.
Figure 8A:
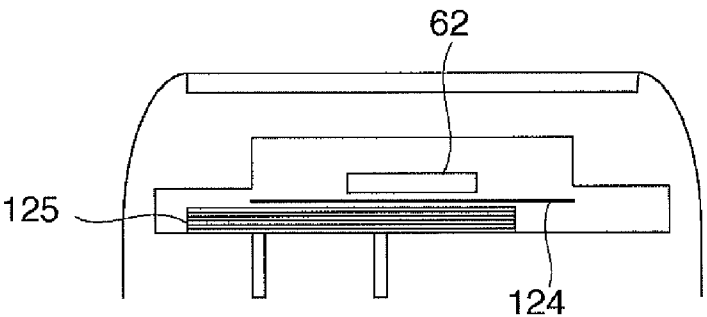
FIG. 8A is a schematic view of the post-processing apparatus as seen from the downstream side in the sheet discharge direction, with the sorting member in contact with the recording sheet.
Figure 9B:
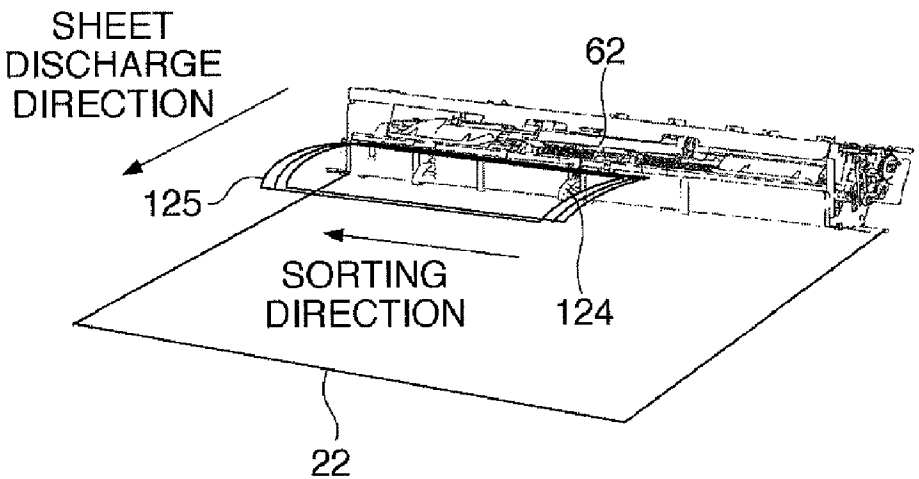
FIG. 9B is a schematic view of the post-processing apparatus as seen from obliquely above, with the sorting member moved in the sorting direction.

FIGS. 7A to 9B schematically show the operation of the sorting member 62 in FIG. 3. FIGS. 7A, 8A and 9A schematically show the post-processing apparatus 33 in FIG. 3 as seen from the downstream side in the sheet discharge direction. FIGS. 7B, 8B and 9B schematically show the post-processing apparatus 33 as seen from obliquely above.

Reference numeral 124 denotes a discharged recording sheet, and reference numeral 125 denotes recording sheets waiting for being stapled. When the recording sheet 124 has been discharged from the printer unit 1 to the post-processing apparatus 33, the sorting member 62 is moved downward from a position shown in FIG. 7A to a position shown in FIG. 8A, such as to be brought in contact with the recording sheet.

Figure 9A:
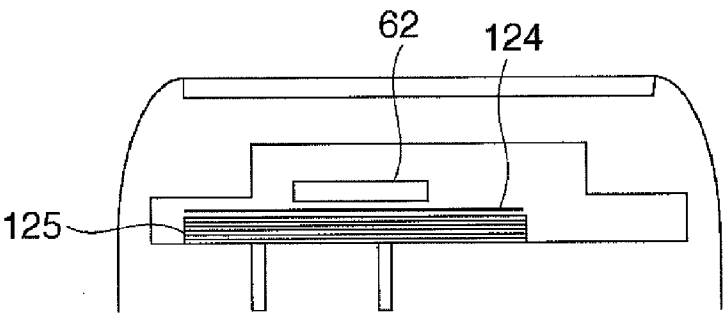
FIG. 9A is a schematic view of the post-processing apparatus as seen from the downstream side in the sheet discharge direction, with the sorting member moved in a sorting direction.

The sorting member 62 made in contact with the recording sheet 124 is moved in the sorting direction, as shown in FIG. 9A, while remaining in contact with the recording sheet 124, whereby the recording sheet 124 is sorted. Recording sheets 124 moved in succession in the sorting direction are stacked on the recording sheets 125 waiting for being stapled, until the number of stacked sheets reaches a staple number of sheets.

When the staple number of sheets is reached, the stacked recording sheets 125 are stapled and then discharged. Toner fusion sometimes occurs when the sorting member 62 is moved downward from FIG. 7A to FIG. 8A and the recording sheet 124 is made in pressure contact with the recording sheets 125 waiting for being stapled.

If, in this state, toner fusion takes place between recording sheets, the discharged recording sheet 124 cannot sufficiently be moved to the sorting position. As a result, alignment failure of recording sheets can occur at the time of sorting, and pages missing can occur at the time of stapling.

Next, a description will be given of the detection of toner density.

As previously described with reference to FIG. 1, the laser exposure unit 7 irradiates laser light from the laser emitting unit in accordance with an externally input color-separated image signal, and the laser light is irradiated via the polygon lens, the reflection mirror, etc. onto the photosensitive drums 2*a*-2*d* on which electrostatic latent images in respective colors are thereby formed.

Figure 10:
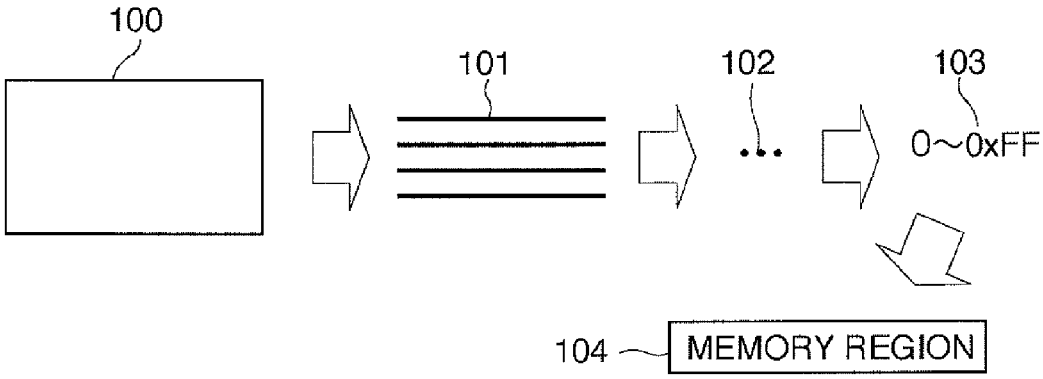
FIG. 10 is a schematic view showing a toner image formed in the image forming apparatus in FIG. 1.

FIG. 10 schematically shows a toner image formed in the image forming apparatus in FIG. 1.

As shown in FIG. 10, a toner image 100 on each page is an aggregate of laser scanned lines 101, wherein each of the lines 101 is an aggregate of dots 102 formed in accordance with the waveform of a laser signal.

In this embodiment, the apparatus has performance of forming 600 dots per inch in default. Electric potential 103 (toner transfer rate) at each dot 102 of the toner image 100 is controlled to a desired one of 16 levels from 0 to 15, whereby the densities in various parts of the electrostatic latent image are determined.

At the time of laser irradiation, a value obtained by integrating electric potentials at respective dots in a one-page image is stored into the memory region 104, whereby toner density information on the one-page image can be obtained. In the following, with reference to FIG. 11, toner fusion determination based on the toner density on a A3 size recording sheet (297 mm×420 mm) will be described.

Figure 11:
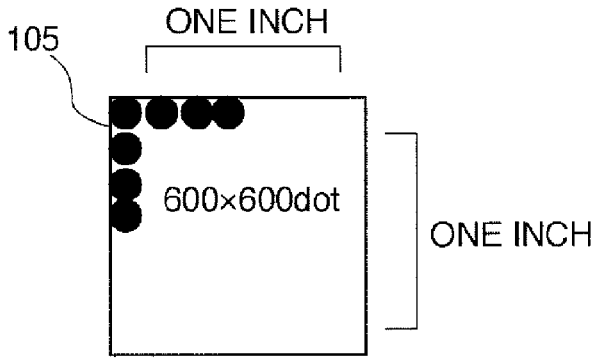
FIG. 11 is a schematic view showing a toner image formed in the image forming apparatus in FIG. 1.

FIG. 11 schematically shows a toner image formed in the image forming apparatus in FIG. 1.

In a case that the printing density representing the printing performance of the image forming apparatus is 600 dots per inch (25.4 mm) as shown in FIG. 11, the number of dots in a one-page image is equal to (297/25.4)×600×(420/25.4)×600. Electric potentials at all the dots in each one-page image are obtained and an integrated value of the electric potentials is calculated. If the integrated value is equal to or greater than a predetermined value, it is determined that a toner use amount used for the one-page image is large and hence there is a high possibility of occurrence of toner fusion between recording sheets due to the pressure contact by the sorting member 62.

Next, a description will be given of control of a conveyance time interval for recording sheets P. The conveyance time interval control is implemented by the CPU 171.

Figure 12:
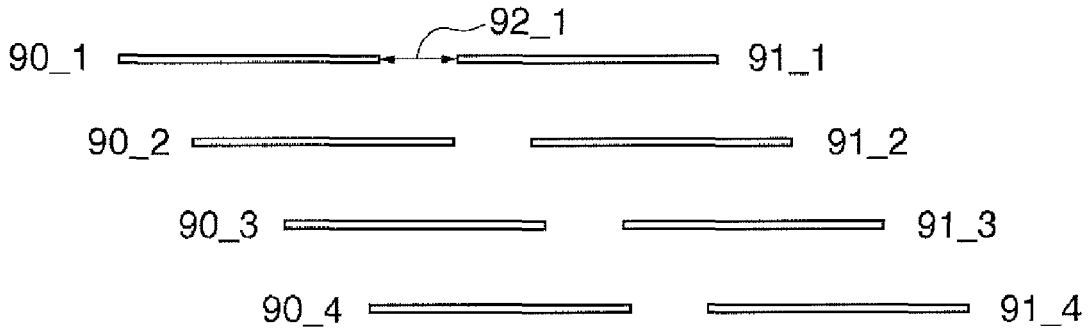
FIG. 12 is a view showing laser irradiation times (laser irradiation on/off timings) by a laser exposure unit in FIG. 1 for formation of respective color toner images and conveyance time intervals between first and second pages of recording sheets at the time of color image formation.
Figure 13:
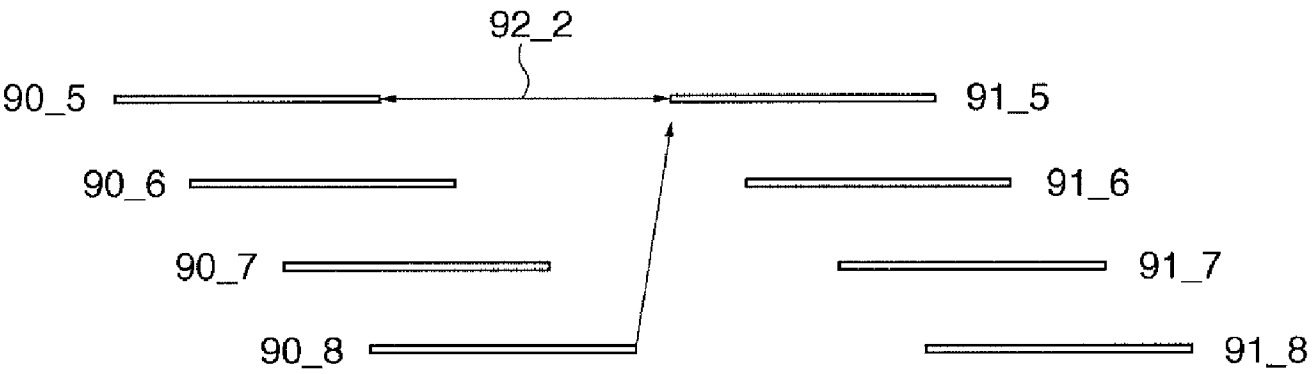
FIG. 13 is a view showing laser irradiation times for a case where the recording sheet conveyance time interval is made longer than that shown in FIG. 12.
Figure 14:
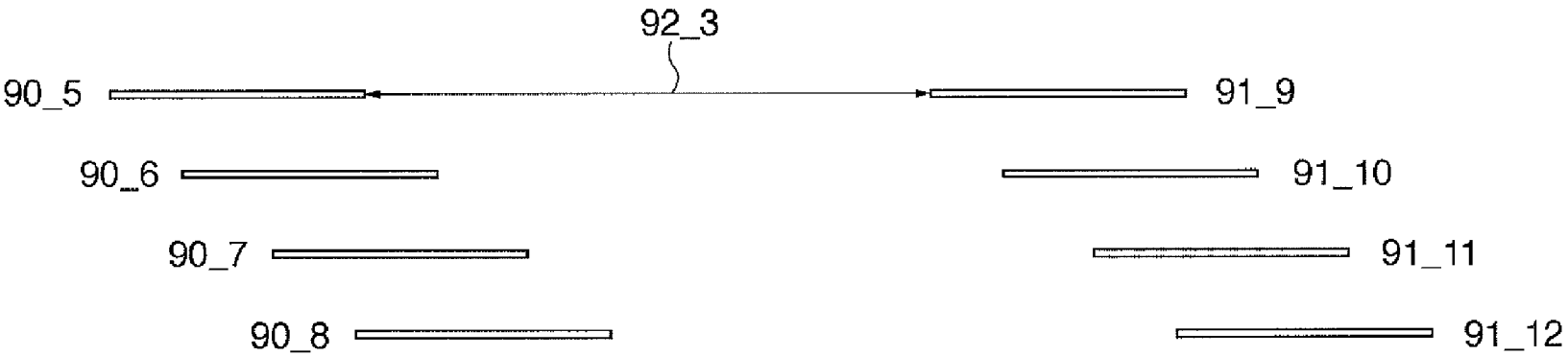
FIG. 14 is a view showing laser irradiation times for a case where the recording sheet conveyance time interval is made longer than that shown in FIG. 13.
Figure 15:
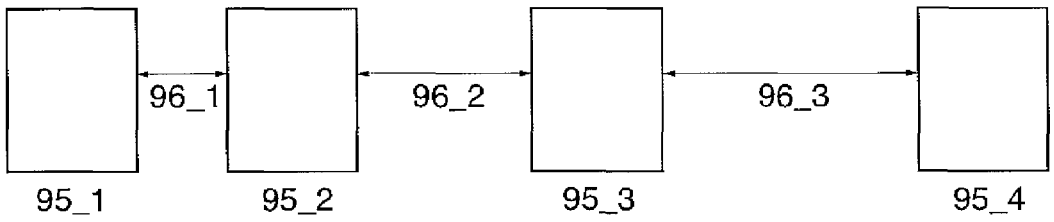
FIG. 15 is a view showing recording sheet conveyance intervals respectively corresponding to three recording sheet conveyance time intervals shown in FIGS. 12 to 14.

FIGS. 12 to 14 show laser irradiation times (laser irradiation on/off timings) by the laser exposure unit 7 in FIG. 1 for formation of respective color toner images and conveyance time intervals between first and second pages of recording sheets at the time of color image formation. The conveyance time interval becomes longer in the order of FIGS. 12, 13 and 14. FIG. 15 shows conveyance intervals 96_1 to 96_3 between adjacent ones of recording sheets 95_1 to 95_4.

In a case that, as shown in FIG. 12, a minimum value 92_1 is set as the conveyance time interval between the first page recording sheet and the second page recording sheet to maximize the productivity, the yellow toner image formation 91_1 for the second page is started before completion of the black toner image formation 90_4 for the first page. Hereinafter, the minimum conveyance time interval 92_1 will be referred to as the first conveyance time interval, which corresponds to the recording sheet conveyance interval 96_1 in FIG. 15.

FIG. 13 shows laser irradiation times (laser irradiation on/off timings) for the formation of respective color toner images at the time of color image formation in a case that a second conveyance time interval 92_2 is set as the recording sheet conveyance time interval (which corresponds to conveyance time). The second conveyance time interval 92_2 is longer than the first conveyance time interval 92_1.

In a case that the second conveyance time interval 92_2 is set as the recording sheet conveyance time interval, first toner image formation 91_5 for the second page is not started under the control of the CPU 171 until completion of fourth toner image formation 90_8 for the first page. The second conveyance time interval 92_2 is longer than the first conveyance time interval 92_1 and corresponds to the recording sheet conveyance interval 96_2 in FIG. 15.

FIG. 14 shows laser irradiation times (laser irradiation on/off timings) for the formation of respective color toner images in a case where the third conveyance time interval 92_3 longer than the second conveyance time interval 92_2 is set as the recording sheet conveyance time interval.

In a case that the third conveyance time interval 92_3 is set as the recording sheet conveyance time interval, the recording sheet conveyance time interval is made wider to the extent that toner fusion does not occur between recording sheets P which are conveyed in succession. The third conveyance time interval 92_3 is longer than the first and second conveyance time intervals 92_1, 92_2 and corresponds to the recording sheet conveyance interval 96_3 in FIG. 15.

Next, a description will be given of recording sheet conveyance control implemented by the CPU 171 in FIG. 6 to avoid occurrence of toner fusion.

In image formation on plural sets of recording sheets, the control content is different between when image formation is performed on a first set of recording sheets and when performed on a second and subsequent sets of recording sheets.

At the time of image formation on the first set of recording sheets, the CPU 171 starts the conveyance control to transfer recording sheets at the second conveyance time interval. Upon each completion of one-page image formation, the CPU 171 determines whether or not a toner use amount used for the image formation on the page concerned is equal to or greater than a predetermined amount. In the image formation on recording sheets conveyed at the second conveyance time interval, image formation on the next page is not started until completion of the image formation on the preceding page.

Therefore, when it is determined that the toner use amount used for the preceding page is large, the conveyance time interval between the preceding page and the next page can easily be widened to the third conveyance time interval. If it is determined that the toner use amount used for the preceding page is large, the CPU 171 widens the conveyance time interval between the preceding page and the next page to the third conveyance time interval, and starts the image formation processing for the next page after the preceding page is sufficiently cooled.

If the toner use amount used for the preceding page is less than the predetermined amount, the CPU 171 determines that toner fusion hardly takes place between the preceding page and the next page, and continues the operation of conveying recording sheets P at the second conveyance time interval. Even if the conveyance time interval has been once widened to the third conveyance time interval, when it is determined that toner fusion will not occur in subsequent pages, the CPU 171 puts the conveyance time interval back to the second conveyance time interval, and continues the operation of conveying recording sheets P.

Figure 16:
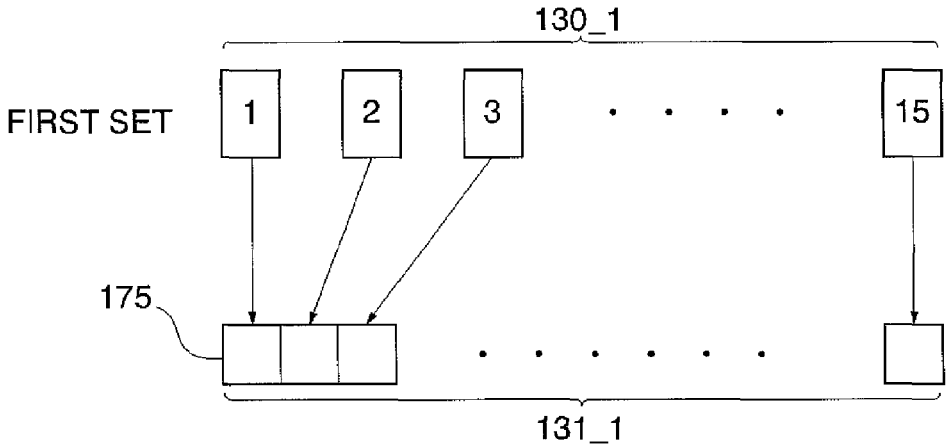
FIG. 16 is a view showing how toner use amounts used for image formation on respective pages of a first set are stored into a RAM shown in FIG. 6.

During the image formation on the first set of recording sheets, the CPU 171 stores toner use amounts 130_1 used for respective ones of all the pages (15 pages in the illustrated example) into a storage buffer (for example, the RAM 175 in FIG. 6), as shown in FIG. 16 (storage 131_1).

At the time of image formation on the second and subsequent sets of recording sheets, the CPU 171 starts the conveyance control to transfer recording sheets at the third conveyance time interval. As for the first page of each set, post-processing on the preceding set is already completed and is output to the sheet discharge tray 22. Therefore, it is unnecessary to widen the conveyance interval between the preceding set and the next set.

Next, with reference to FIGS. 16 and 17, a process for estimating toner use amounts for image formation on the second and subsequent sets will be described. This estimation process is implemented by the CPU 171.

In the processing for estimating a toner use amount for each page of the second or subsequent sets, the toner use amount 130_2 is used, which is stored in the RAM 175 for the corresponding page of the first or preceding set. This is because that the toner use amount in image formation on each page of recording sheets is the same between respective sets.

The CPU 171 is able to estimate a toner use amount for each page of the second set or the subsequent sets before completion of image formation on each page based on the toner use amount stored in the RAM 175 for the same page of the first set or the preceding set. If the estimated toner use amount is small, the CPU 171 is able to carry out the conveyance control not at the second conveyance time interval used for the first set but at the first conveyance time interval which is the shortest conveyance time interval.

Figure 17:
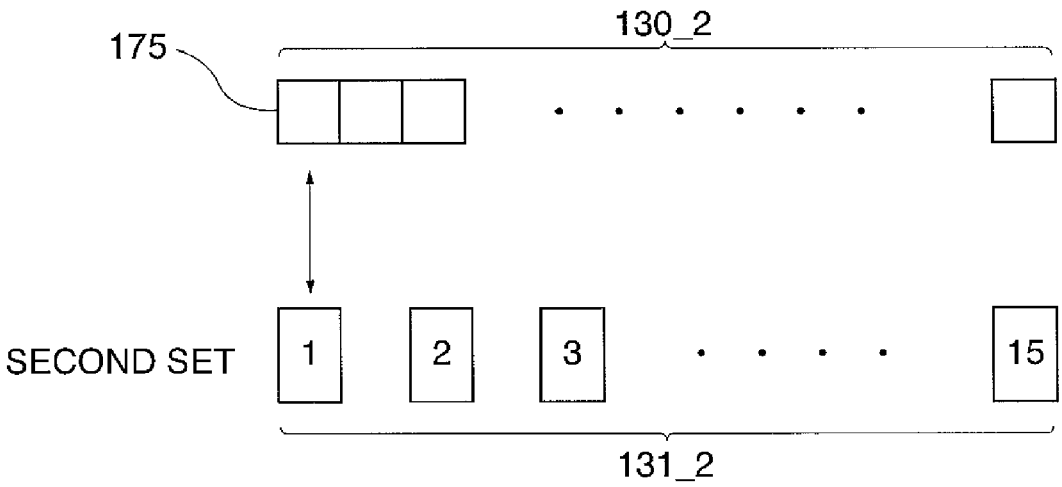
FIG. 17 is a view showing how a break between sets is determined in a case that image formation is performed on plural sets of recording sheets.

The toner use amount used for the current page may be compared with the toner use amount stored in the RAM 175 for the first page of the first set or the preceding set, and a break between sets (the first page of each sets) may be determined when both the toner user amounts are coincident with each other (see FIG. 17).

Figure 18:
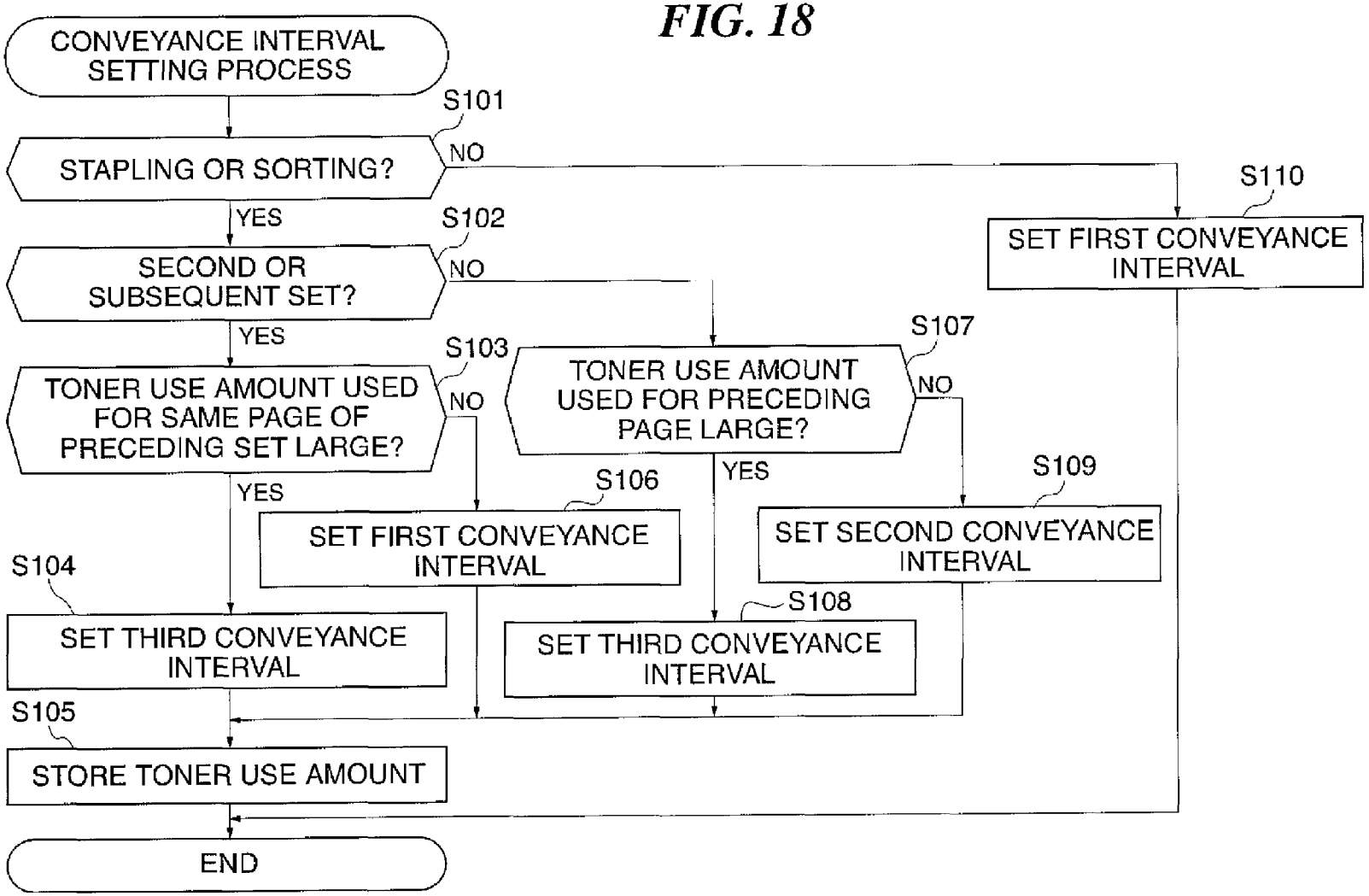
FIG. 18 is a flowchart showing the procedures of a recording sheet conveyance interval setting process implemented by the image forming apparatus in FIG. 6.

FIG. 18 shows in flowchart the procedures of a recording sheet conveyance interval setting process implemented by the image forming apparatus in FIG. 6. This process is implemented by the CPU 171 in FIG. 6.

In the conveyance interval setting process in FIG. 18, when a job is given, the CPU 171 determines whether or not the current operation mode is a post-processing mode in which tone fusion can sometimes take place. In this embodiment, it is determined whether or not the current mode is staple processing or sort processing to thereby determine whether or not the current operation mode is the post-processing mode (step S101). If the current operation mode is not stapling nor sorting, the CPU 171 determines that there is a low possibility of occurrence of toner fusion, and therefore sets the first recording sheet conveyance interval 96_1 as the recording sheet conveyance interval (step S110).

On the other hand, if it is determined at step S101 that the current operation mode is stapling or sorting, the CPU 171 determines whether or not the current image forming operation is carried out for the second or subsequent sets (step S102).

If it is determined at step S102 that the current image forming operation is carried out for the first set, the CPU 171 determines whether or not a toner use amount used for image formation on the preceding page is larger than the predetermined amount (S107). If the toner use amount is larger than the predetermined amount, the third conveyance interval 96_3 wider than the first and second conveyance intervals 96_1, 96_2 is set as the conveyance interval for the next page (step S108). If the toner use amount is not larger than the predetermined amount, the CPU 171 sets the second conveyance interval 96_2 as the conveyance interval for the next page (step S109). As for the first page, the flow proceeds from step S107 to step S109. Next, the CPU 171 stores the toner use amount used for the current page into the RAM 175 (step S105). Whereupon, the conveyance interval setting process in FIG. 18 is completed.

If it is determined in step S102 that the current image forming operation is implemented for the second or subsequent set, the CPU 171 determines whether or not the toner use amount used for the image formation on the same page of the preceding set and stored in step S105 into the RAM 175 is larger than the predetermined amount (step S103).

If the toner use amount used for the same page of the preceding set is larger than the predetermined amount, the CPU 171 sets the third conveyance interval 96_3 as the recording sheet conveyance interval (step S104). If the toner use amount is less than the predetermined amount, the first conveyance interval 96_1 narrower than the third conveyance interval 96_3 is set as the recording sheet conveyance interval (step S106).

In this embodiment, for the first set, the CPU 171 sets the second or third conveyance interval based on the toner use amount, as described above. As a result, the image formation on recording sheets of the first set is completed before start of image formation on recording sheets of the second set. For the second and subsequent sets, the CPU 171 sets the first or third conveyance interval based on the toner use amount stored in the RAM 175 for the preceding set.

Figure 19:
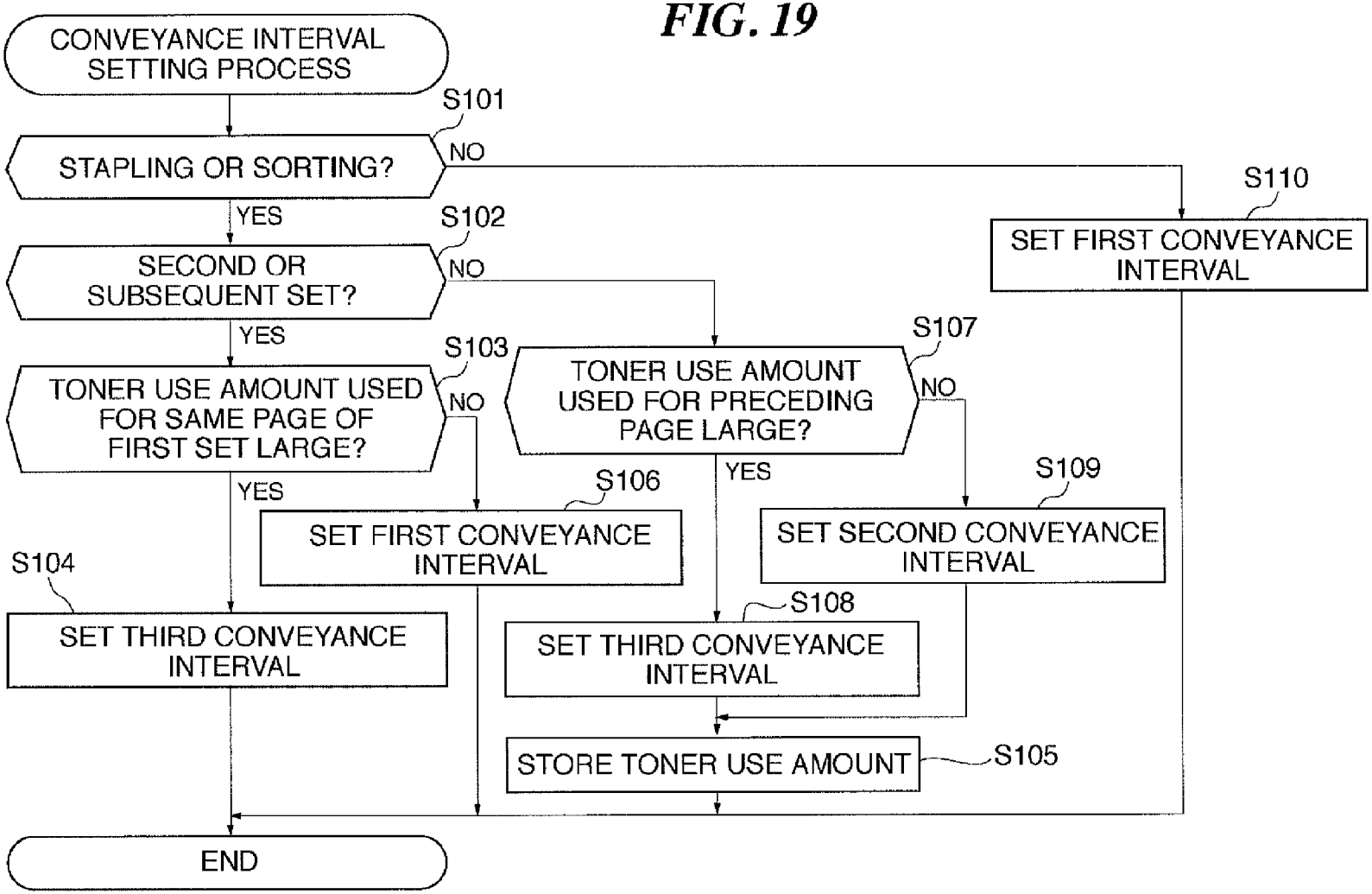
FIG. 19 is a flowchart showing the procedures of a recording sheet conveyance interval setting process according to a modification of the embodiment.

It should be noted that only the toner use amounts used for respective pages of the first set may be stored. In that case, as shown in FIG. 19, the toner use amount for the same page of the first set is referred to in step S103. In step S104 or S106, the recording sheet conveyance interval is set. Thereafter, the conveyance interval setting process in FIG. 18 is completed, without toner use amount being stored.

The changeover between the first, second, and third conveyance intervals by the CPU 171 is also applicable to a case where post-processing other than stapling and sorting is carried out on recording sheets P by the post-processing apparatus 33.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2007-197494, filed Jul. 30, 2007 which is hereby incorporated by reference herein in its entirety.

What is claimed is:

1. An image forming apparatus comprising:

an image forming unit configured to form a toner image onto a recording sheet;

a fixing unit configured to thermally fix the toner image onto the recording sheet;

a detection unit configured to detect a toner use amount when the toner image is formed by said image forming unit;

a storage unit configured to store toner use amounts detected by said detection unit for respective pages; and a control unit adapted to control a recording sheet conveyance interval, wherein said control unit controls the recording sheet conveyance interval in image formation on a first set of plural sets based on a toner use amount detected by said detection unit for each page of the first set and causes said storage unit to store toner use amounts used for respective pages of at least the first set, and controls the recording sheet conveyance interval in image formation on a second set following the first set of the image formation based on the toner use amount stored, in image formation of the first set, in said storage unit for each page of the second set.

2. The image forming apparatus according to claim 1, wherein said control unit determines a break between the plural sets based on the toner use amount detected by said detection unit for each page and the toner use amount stored in said storage unit for each page.

3. The image forming apparatus according to claim 1, wherein said control unit selects the recording sheet conveyance interval from among a plurality of recording sheet conveyance intervals, which are set in advance.

4. The image forming apparatus according to claim 1, wherein when the detected toner use amount of one of the pages of the first set is less than a predetermined amount, said control unit determines a recording sheet conveyance interval to be determined for the one of the pages of the second set is narrower than a recording sheet conveyance interval determined based on the detected toner use amount of the one of the pages of the first set.

5. The image forming apparatus according to claim 1, including a post-processing apparatus adapted to carry out post-processing on recording sheets, wherein said control unit does not control the recording sheet conveyance interval based on the toner use amount in a case where particular post-processing is not carried out on recording sheets.

6. The image forming apparatus according to claim 5, wherein the particular post-processing includes at least one of staple processing and sort processing.

* * * * *